United States Patent [19]

Parrilla

[11] 3,946,444

[45] Mar. 30, 1976

[54] METHOD OF TYING A NECKTIE

[76] Inventor: Salvatore C. Parrilla, 6198 Stratford Drive, Parma Heights, Ohio 44130

[22] Filed: Jan. 13, 1975

[21] Appl. No.: 540,415

Related U.S. Application Data

[63] Substitute for Ser. No. 165,515, July 26, 1971, abandoned.

[52] U.S. Cl. ..... 2/144

[51] Int. Cl.[2] ..... A41D 25/00

[58] Field of Search ..... 2/148, 149, 150, 153, 155, 2/156, 144, 145

[56] References Cited

UNITED STATES PATENTS

| | | | |
|---|---|---|---|
| 1,125,793 | 1/1915 | Barnes | 2/150 |
| 1,227,677 | 5/1917 | Schleorb | 2/148 |
| 1,878,604 | 9/1932 | Rodeback | 2/146 |
| 2,100,870 | 11/1937 | Petrie et al. | 2/145 |
| 2,103,094 | 12/1937 | Scharlin | 2/150 |

FOREIGN PATENTS OR APPLICATIONS

| | | | |
|---|---|---|---|
| 1,133,706 | 4/1957 | France | 2/145 |

*Primary Examiner*—Patrick D. Lawson
*Attorney, Agent, or Firm*—Baldwin, Egan, Walling & Fetzer

[57] ABSTRACT

A method of tying a necktie of a modified four-in-hand type and having a narrower portion to go around the neck of the wearer and a wider portion to hang down the front of the wearer and at least two small openings through the necktie spaced lengthwise thereof and bound, as with grommets, near the zone where the knot would appear in a regular four-in-hand tie. The narrower end of the tie passes through the openings with a snug sliding fit. In use of the method, the narrow end of the tie is threaded up and down through the openings, after which the narrower end of the tie is tightened by pulling the narrow end more or less through the openings, after which the wider end of the tie is brought upwardly through the loop on the side toward the neck of the wearer and then forwardly over and down to hang in display fashion in front of the wearer.

1 Claim, 8 Drawing Figures

INVENTOR.
SALVATORE C. PARRILLA
BY
Baldwin, Egan, Walling & Fetzer
ATTORNEYS

METHOD OF TYING A NECKTIE

An object of the present invention is to provide means whereby to avoid tying and untying a knot as in a four-in-hand necktie and to provide a more or less permanent loop in a narrower part of the necktie intended to go around the neck of the wearer so that the tie may be easily slipped over the head of the wearer and the loop is quickly loosened or tightened by a sliding movement of the hand of the wearer. This invention also preserves the good appearance of the tie over a long period of use without the display portion of the tie becoming wrinkled.

Other objects and advantages of the invention will be apparent from the accompanying drawings and specification and the essential features thereof will be set forth in the appended claims.

In the drawings,

FIGS. 3 and 4 are different views of the tie in its final position on the neck of the wearer, with FIG. 3 showing a generally side elevation with the parts in position, while FIG. 4 is taken from the left-hand side of FIG. 3 and with the neck loop slightly raised to more clearly disclose the position of the parts;

FIG. 7 is a fragmental view of the narrower end of a tie as shown in FIGS. 1 or 6 and showing a retainer fixed in the tie to prevent the same from being disassembled from the position shown in FIG. 2; while

Figure 1:
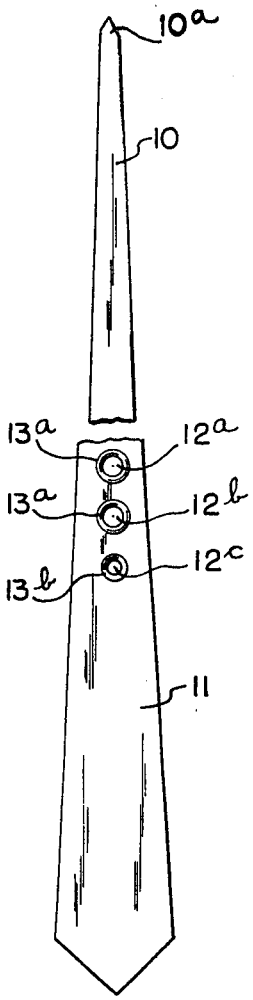
FIG. 1 is a plan view of a modified four-in-hand tie embodying this invention.
Figure 2:
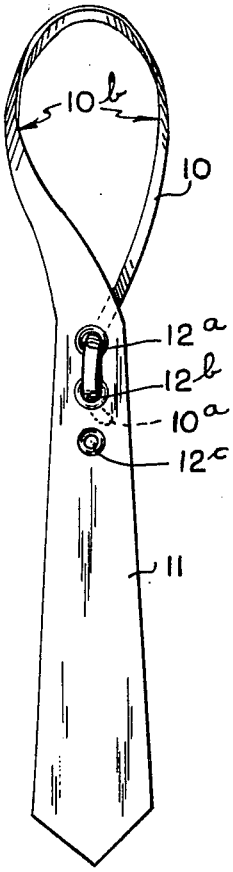
FIG. 2 shows the tie of FIG. 1 with a neck loop formed in the same by passing the narrower end of the tie threaded in and out of plural openings through the tie.
Figure 8:
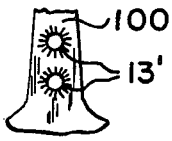
FIG. 8 is a fragmental plan view of the mid-portion of a tie like FIG. 6 showing another manner in which the small openings may be bound by the use of stitching.

FIGS. 1 through 4 show a long necktie, approximately 48 inches or so long, modified from the type usually used as a four-in-hand tie which in the known manner is looped around the neck of the wearer and a knot formed at the wearer's neck which is then pulled up tight, leaving two ends generally parallel extending downwardly in front of the wearer. To avoid the continued knotting and unknotting of such a tie, the method of this invention utilizes at least two small bound openings, which extend through the tie near the zone where the narrower neck loop portion 10 joins the wider display portion 11. Here three of such openings, 12*a*, 12*b* and 12*c*, are shown which are bound by fastening brass grommets 13*a* or 13*b* in the openings. These openings are progressively spaced longitudinally of the tie. An alternative manner of binding the openings is shown by the stitching of FIG. 8 in the same manner as eyelets are usually bound. While these openings are shown as circular, it should be understood that they might be made more like ordinary buttonholes, if desired. One form of tie used in the method of the invention is a necktie 48 to 50 inches long with the wider portion 11 tapering from over 2½ inches in width at its wider end in a regular manner, in this case from a width of 4 inches to a width of one inch in a regular manner for a length of about 32 inches. Then the narrower portion of the tie tapers from about one inch or a little more to about ¾ inches wide at the narrower end of the tie, this extending for a length of 16 or 18 inches along the tie. In this one embodiment, the grommet 13*b*, nearest the broad end of the tie, was about 18 to 24 inches from the lower end of the tie as seen in FIGS. 1 and 2. In this embodiment, the grommets were placed about 1¾ to 1½ inches center to center and the grommets had openings between about ¼ inch to ⅜ inches in diameter. The essential point is that the narrower end of the tie at 10*a* should have a thickness to provide a snug sliding fit in the openings 12*a*, 12*b* and 12*c*.

Figure 3:
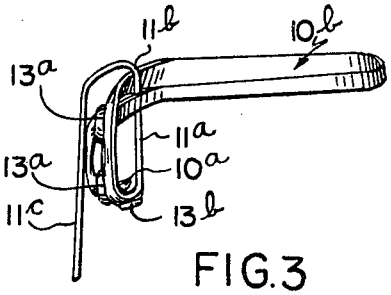
Figure 4:
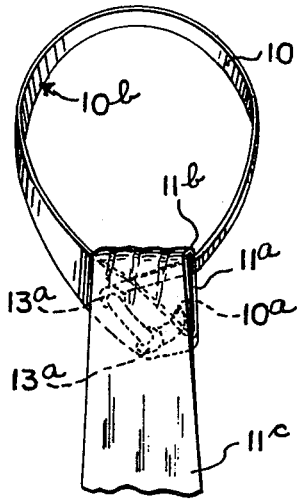

In using the tie according to the method of this invention, the wearer threads the narrower end 10*a* from one face of the necktie, the lower face in FIG. 2, upwardly through the opening 12*a* and then in the opposite direction, downwardly, through another opening 12*b* so as to form a loop 10*b* in the narrower portion of the tie, which loop is sufficiently large to pass over the head of the wearer. It should be understood that the narrower end 10*a* might first be passed from the upper surface of the tie through and underneath the tie and then up through the second opening 12*b*, if desired. The loop 10*b* is formed as described either before or after the loop is around the neck of the wearer. The wearer then manipulates the tie from the position of FIG. 2 by grasping the narrower end of the tie at 10*a* with one hand while relatively moving the broader portion of the tie upward and the narrower portion of the tie downward through the opening 12*a* and 12*b* until the loop 10*b* is snug around the wearer's neck. He then takes the wider end of the tie 11 and pushes a portion upwardly at 11*a* through the loop 10*b* and nearer the neck of the wearer, then passing forward over the loop 10*b* at 11*b* and then folding the same downwardly in display fashion in front of the wearer as at 11*c* in FIGS. 3 and 4. As seen in FIG. 3, the wider display portion then hides the narrower portion where it passes through the openings 12*a* or 12*b* or 12*c*. This causes no wrinkling of the tie material at the portions 11*b* and 11*c* which are the display portion of the tie seen by others.

It should be obvious that when three or more small openings as at 12*a*, 12*b* and 12*c* are provided, it permits the wearer to adjust the length of the tie as for instance by using the openings 12*b* and 12*c* to provide a large opening 10*b* rather than using the openings 12*a* and 12*b* as just described. This invention also includes a row of four, five or more small openings, if desired, in the use of this invention.

Figure 5:
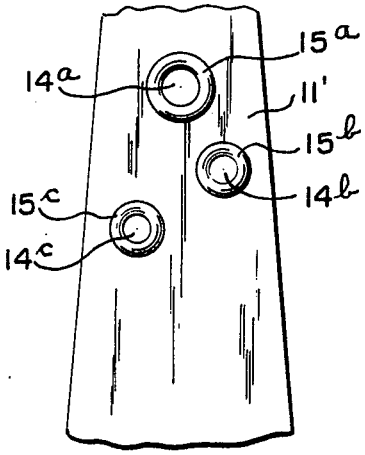
FIG. 5 is a partial plan view, enlarged, of another modified four-in-hand tie similar to FIG. 1 but with the small bound openings through the tie in a slightly different arrangement.

A modification of the openings through the tie is shown in FIG. 5 where the wider portion of the tie is indicated at 11', the tie otherwise being like that described in FIGS. 1 and 2 except for the small openings. Here, the openings are not shown in line but are in a staggered arrangement as shown at 14*a*, 14*b* and 14*c*. Here again, each opening is bound by fastening a grommet of brass or the like through the tie as shown at 15*a*, 15*b* and 15*c*. In one embodiment, the three openings were respectively on ½ to 1¼ inch centers, but so arranged that the centers of the openings 14*a* and 14*c* were spaced approximately 2¼ inches. The tie of FIG. 5 can be utilized in the same manner as the first embodiment by threading the narrower end of the tie either starting up or down through the tie and using any two of the openings shown in FIG. 5. Here again, the selection of the opening varies the length of the tie displayed by the wearer.

Figure 6:
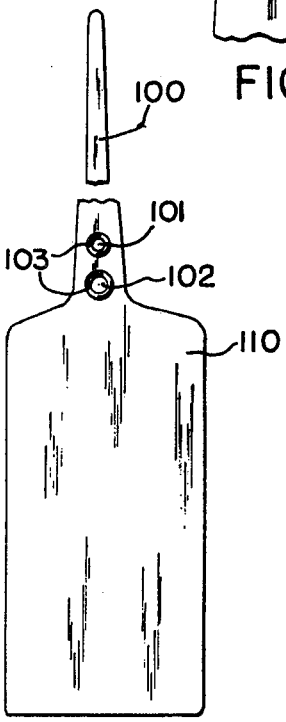
FIG. 6 is a plan view of another tie, the "Stroller" or Ascot type, embodying this invention.

FIG. 6 shows a different style of tie where the display portion is generally rectangular and the narrower portion of the tie is similar to that shown in FIGS. 1 and 2. This kind of tie in one form is known as a "Stroller" tie, commonly about 4 to 5 inches wide, or where it is of the Ascot type, then it may be as much as eight inches or so in width. In both of these cases, a square lower end of the tie is preferred. Here the broader portion of the tie is indicated at 110 and the narrower portion is indicated at 100. Two small openings 101 and 102 are shown extending through the tie and protected by suitable grommets 103. The openings 101, 102 are near the zone where the narrower portion of the tie joins the wider portion. The spacing and number of such holes may be as previously described. Here the holes are shown bound with metal grommets 103. This tie is manipulated as described in connection with FIGS. 2, 3 and 4 of the first embodiment.

Figure 7:
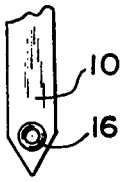

In some cases it may be desirable to assemble the tie as shown in FIG. 2 and then provide means whereby the narrow end 10 is never removed from the openings 12*a* and 12*b*. In FIG. 7, there is shown a grommet 16 firmly fixed in the distal end of the narrower portion 10 of the tie, this grommet 16 being of a size which will not pass through the openings 12*a*, 12*b* or 12*c*. Thus, the tie is permanently assembled in this fashion and can be placed over the user's head, when worn, and removed thereafter and hung up, suspended from the loop 10*b* so that the tie receives a minimum of handling and remains clean and fresh for a long period of time.

What is claimed is:

1. The method of tying a long necktie wider at one end and narrower at the other around the neck of a wearer, said tie having at least two longitudinally spaced bound small through openings in its mid-portion, comprising threading the narrower end of said tie up and down through said openings forming a loop to pass around the wearer's neck, tightening said loop by pulling said narrower end through said openings, and passing the wider end of said tie upwardly through said loop on the side toward the neck of the wearer and then forward over the loop and downward to hang in display fashion in front of the wearer with said wider portion covering said narrower portion in said openings.

* * * * *